US007409942B2

(12) United States Patent
Hashiba

(10) Patent No.: US 7,409,942 B2
(45) Date of Patent: Aug. 12, 2008

(54) RECOIL STARTER

(75) Inventor: Hideki Hashiba, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 11/637,013

(22) Filed: Dec. 12, 2006

(65) Prior Publication Data

US 2007/0131190 A1 Jun. 14, 2007

(30) Foreign Application Priority Data

Dec. 14, 2005 (JP) ..... P2005-360863

(51) Int. Cl.
*F02N 3/02* (2006.01)
*F02N 3/00* (2006.01)

(52) U.S. Cl. ..... 123/185.3; 123/185.2

(58) Field of Classification Search ..... 123/185.1, 123/185.2, 185.3; 74/6

See application file for complete search history.

(56) References Cited

U.S. PATENT DOCUMENTS 6,722,336 B2 * 4/2004 Nieda et al. ..... 123/185.14
6,755,170 B2 6/2004 Morishige et al.
6,971,359 B2 12/2005 Tohyama
6,981,482 B2 1/2006 Tsunoda et al.
7,093,577 B2 8/2006 Tohyama
2003/0213455 A1 * 11/2003 Tohyama ..... 123/185.3
2004/0079313 A1 * 4/2004 Tsunoda et al. ..... 123/185.3
2004/0250787 A1 * 12/2004 Tohyama ..... 123/185.3
2006/0070596 A1 4/2006 Horikoshi

FOREIGN PATENT DOCUMENTS

JP 2006-132519 5/2006

* cited by examiner

*Primary Examiner*—Stephen K. Cronin
*Assistant Examiner*—Ka Chun Leung
(74) *Attorney, Agent, or Firm*—Nixon & Vanderhye P.C.

(57) ABSTRACT

A recoil starter includes: a rope reel; a cylindrical cam; a coil spring; a reel spindle; an extending cylindrical portion; a recess; a hook; an engaging groove; an inner annular portion; and an outer annular portion, wherein: the extending cylindrical portion is inserted in the inner side of the recess; the coil spring is wound on the outer side of the extending cylindrical portion; the hook is engaged with the engaging groove; an end portion opposite the hook of the coil spring is engaged with the cylindrical cam; the inner annular portion is made flush; and the outer annular portion is made such that a portion corresponding to the engaging groove is formed to have the same height as that of the inner annular portion whereas an opposite side is formed to have a larger height than that of the inner annular portion.

4 Claims, 3 Drawing Sheets

RECOIL STARTER

BACKGROUND OF THE INVENTION

1. Field of the Invention

The present invention relates to a recoil starter for starting an engine by pulling a starter rope wound on a rope reel to thereby rotate the rope reel, by transmitting the rotation of the rope reel to a cam by damper means, by rotating a drive pulley or flywheel magnet connected to the engine side, and by the rotation of the cam.

2. Background Art

There is already known a recoil starter, in which the rotation of the rope reel, as caused by pulling the starter rope, are transmitted to the cam so that the drive pulley on the engine side is rotated through a one-way rotation mechanism such as a centrifugal ratchet to be brought into and out of engagement with that cam. In this recoil starter, there is not only the structure in which the rope reel and the cam are integrated, but also the structure in which the rope reel and the cam are made separate and elastically connected through damper means so that the rotations of the rope reel are transmitted to the cam through a coil spring to thereby absorb the shock caused by the fluctuations of the load at the engine starting time and transmitted to user's the hands.

In the damper type recoil starter, there is also known the constitution in which a cylindrical reel spindle for supporting a rope reel and a cylindrical cam rotatably is so integrated inward on the axis of the output shaft of the engine from the inner face of a starter case formed to cover the side face having the engine output shaft arranged thereon to thereby support the rope reel and the cylindrical cam rotatably on the reel spindle. Moreover, the rope reel and the cylindrical cam are connected by inserting the extending cylindrical portion, as extended on one side of the cylindrical cam, rotatably in the recess formed on one side of the rope reel, and by winding the coil spring on the outer side of the extending cylindrical portion, and by bringing the coil spring into engagement at its one end with the rope reel and at its other end with the cylindrical cam.

Here, the leading end of the extending cylindrical portion of the cylindrical cam and the end portion of the coil spring are arranged such that they overlap the inner side and the outer side of the same seat face of the rope reel, respectively. When the extending cylindrical portion firmly contacts with the seat face of the rope reel, on the other hand, its friction causes a rotational resistance. Therefore, the cylindrical cam rather smoothly rotates, if a clearance is left between the leading end of the extending cylindrical portion and the seat face. When the rope reel is rotated, moreover, the coil spring is wound and fastened so that it is diametrically reduced to come closer to the extending cylindrical portion. When the coil spring is wound and fastened, therefore, the wire at the end portion of the coil spring may enter the clearance between the extending cylindrical portion and the seat face. This entry is easily repeated, once it occurs, to raise a problem that the coil spring is deformed to increase the stress but to deteriorate the durability.

Thus, according to JP-A-2006-132519, there is provided a structure, in which the leading end of an extending cylindrical portion (or a boss 41) of a cam member 15 is fitted in a receiving groove of a rope reel 14 by a faucet joint. According to this structure, the coil spring cannot enter, even if wound and fastened, the clearance between the extending cylindrical portion and the seat face of the end portion of the coil spring.

SUMMARY OF THE INVENTION

However, the aforementioned fitting structure can be adopted only with a recoil starter having a large overall height. If the overall height has to be reduced for a more efficient use of space, it is impossible to adopt the aforementioned structure having the receiving groove.

The present invention contemplates to solve the aforementioned problems, and has an object to provide a recoil starter capable of preventing the entry of a coil spring even at a small overall height.

According to a first aspect of the invention, there is provided a recoil starter including: a rope reel including a starter rope wound thereon with its one end being arranged outside of a starter case, and urged to rewind the starter rope; a cylindrical cam for transmitting the rotation of the rope reel to an output shaft on an engine side; a coil spring for connecting the rope reel and the cylindrical cam; a reel spindle for supporting the rope reel and a cam; an extending cylindrical portion formed to extend on one side of the cylindrical cam; a recess formed in one side of the rope reel; a hook formed at one end of the coil spring; an engaging groove opened in the inner face of the recess; an inner annular portion for receiving the leading end of the extending cylindrical portion; and an outer annular portion for receiving the coil spring, wherein: the extending cylindrical portion is rotatably inserted in the inner side of the recess; the coil spring is wound on the outer side of the extending cylindrical portion; the hook is engaged with the engaging groove; an end portion opposite the hook is engaged with the cylindrical cam; the inner annular portion is formed at the bottom face of the recess, and is made flush; and the outer annular portion is made such that a portion corresponding to the engaging groove is formed to have the same height as that of the inner annular portion whereas an opposite side is formed to have a larger height than that of the inner annular portion.

According to a second aspect of the invention, the hook is formed into a U-letter shape.

According to a third aspect of the invention, the step between the lowest portion and the highest portion of the outer annular portion is one half of the wire diameter of the coil spring.

According to a fourth aspect of the invention, the outer annular portion includes its highest and lowest portions connected on the two sides by symmetric arcuate slope faces.

According to the first aspect of the invention, of the outer annular portion for receiving the coil spring, the portion corresponding to the engaging groove, with which the hook of the end portion of the coil spring engages, is made as high as the inner annular portion, and the opposite side is made higher than the inner annular portion. The hook of the coil spring is the lowest portion to engage with the engaging groove, so that the coil spring cannot enter the clearance between the extending cylindrical portion and the inner annular portion. On the other hand, the portion on the other side of the hook has a step from the inner annular portion, so that the coil spring cannot enter the clearance between the extending cylindrical portion and the inner annular portion. As a result, the coil spring is not deformed so that it neither increases the stress nor deteriorates the durability.

Preventing the entry of the coil spring is not only effected with the structure wherein the fitting groove for fitting the extending cylindrical portion is not formed in the aforementioned recess, but also wherein the opposite side of the hook is raised, while noting the spiral shape of the coil spring, to prevent that entry. The portion corresponding to the engaging groove of the outer annular portion is at the same height as that of the inner annular portion. It is, therefore, unnecessary to increase the overall height for preventing the entry of the coil spring.

According to the second aspect of the invention, the hook of the coil spring is formed in the U-letter shape. Even if the coil spring is wound and fastened while engaging with the engaging groove of the recess of the rope reel, the portion continuing to the hook is held by a portion near the engaging groove but does not come closer to the inner side so that it can be reliably prevented from going below the extending cylindrical portion.

According to the third aspect of the invention, the outer annular portion is the lowest at its hook portion, i.e., at the portion corresponding to the engaging groove, and is higher by one half of the wire diameter at its portion on the opposite side, i.e., at its portion of a half circumference from the hook portion. Thus, if the hook is arranged in the outer annular portion while engaging with the engaging groove, the bottom portion of the entire coil spring abuts against the outer annular portion, and the center of the coil spring is aligned with the center of the extending cylindrical portion of the cylindrical cam. Moreover, the coil spring has its hook engaging with the engaging groove so that it is arranged in a stable position on the outer annular portion. When the coil spring is wound up by pulling the rope, therefore, it is stably wound and fastened.

According to the fourth aspect of the invention, the engaging groove is formed generally into the T-letter shape, and the outer annular portion is formed to connect the two sides of the highest portion and the lowest portion through the symmetric arcuate slope faces. As a result, the constitution can match the coil spring no matter whether the coil spring might be wound clockwise or counter-clockwise.

BRIEF DESCRIPTION OF THE DRAWINGS

Embodiments of the present invention will be described in detail based on the following figures, wherein.

DETAILED DESCRIPTION OF THE EMBODIMENTS

Figure 1:
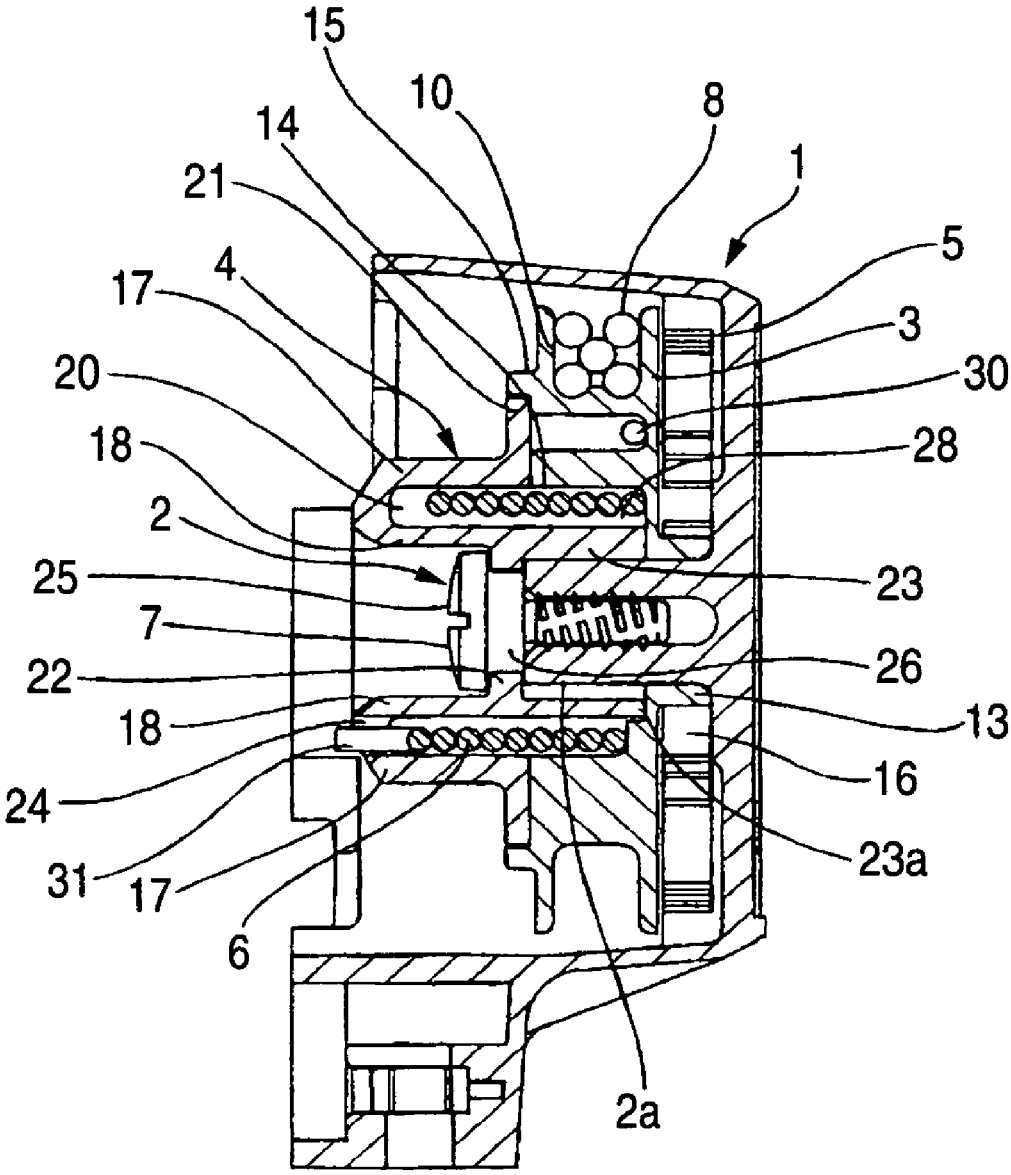
FIG. 1 is a longitudinal side elevation of a recoil starter of the invention.
Figure 2:
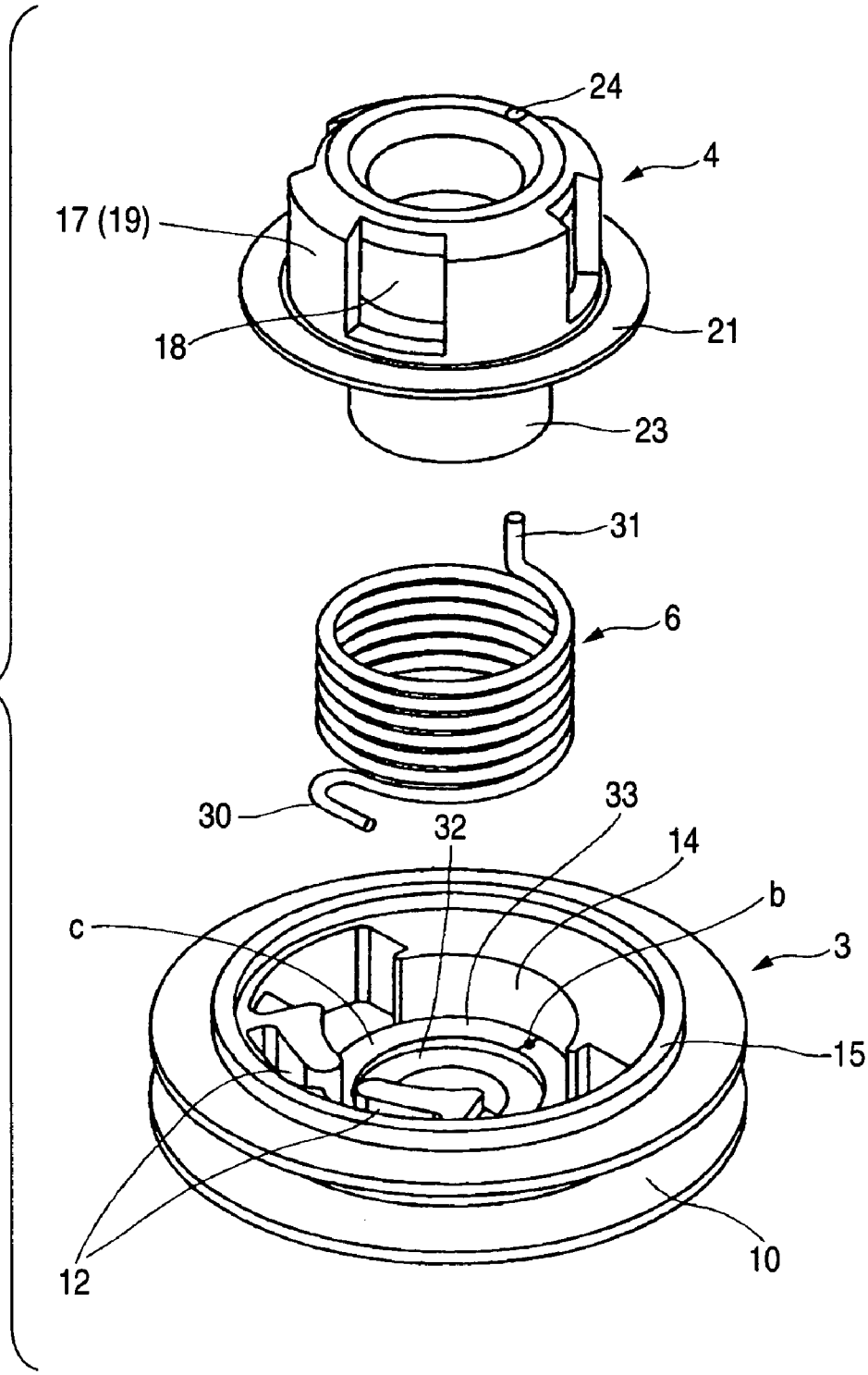
FIG. 2 is an exploded perspective view of the recoil starter.
Figure 3A:
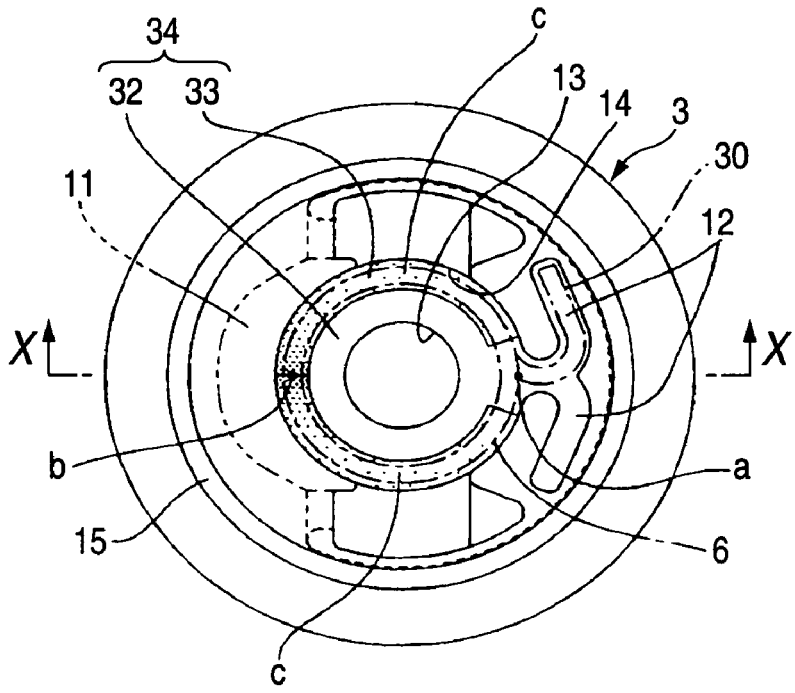
FIG. 3A is a top plan view of a rope reel.
Figure 3B:
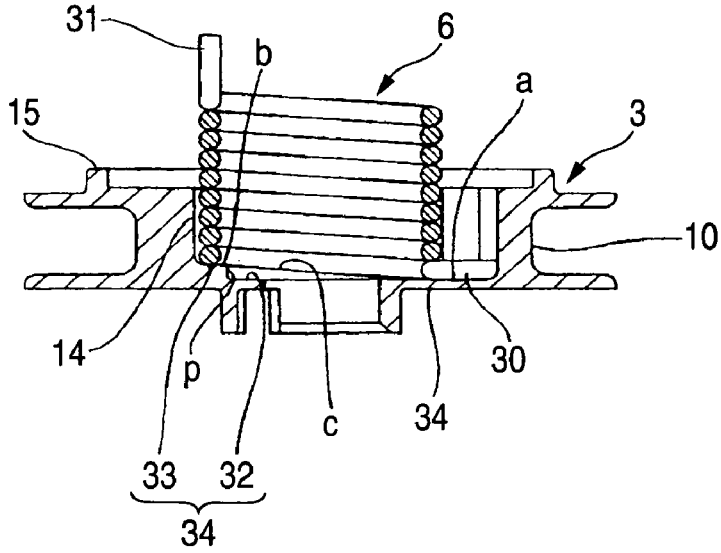
FIG. 3B is a sectional view taken along line X-X of FIG. 3A.

An embodiment of the invention is described in the following with reference to the drawings. FIG. 1 is a longitudinal section of a recoil starter; FIG. 2 is an exploded perspective view of the recoil starter; FIG. 3(*a*) is a top plan view of a rope reel; and FIG. 3(*b*) is a sectional view taken along line X-X of FIG. 3(*a*).

The recoil starter is assembled in a starter case 1. This starter case 1 is attached to the side on which the output shaft of an engine is arranged. From the inner side of the starter case 1 to the side of the output shaft of the engine, there is protruded a reel spindle 2, which supports a rope reel 3 and a cylindrical cam 4 rotatably. Moreover, a spiral spring 5 is housed on the side face of the rope reel 3, and a coil spring 6 is housed between the cylindrical cam 4 and the rope reel 3.

A detailed description of the relation between the recoil starter and the engine is omitted because the relation is well known in the art.

The reel spindle 2 is constituted to include a spindle portion 2*a* formed integrally with the starter case 1, and a set screw 7 screwed from the leading end of the spindle portion 2*a*.

A housing groove 10 of a starter rope 8 is formed in the outer circumference side of the rope reel 3. In the inner circumference, there are formed a recess 11 (as referred to FIG. 3(*a*)), in which the knot of a rope terminal is arranged, and an engaging groove 12 for engaging with one end of the later-described coil spring 6. This engaging groove 12 is formed generally into a T-letter shape. From one side of the rope reel 3, moreover, there is protruded a bearing portion 13, which is rotatably fitted on the root portion of the spindle portion 2*a* of the reel spindle 2. A recess 14 is formed on the opposite side of the bearing portion 13. Moreover, an annular edge 15 is protruded from the engine side of the housing groove 10.

The spiral spring 5 is housed in a housing portion 16 formed on the outer circumference side of the bearing portion 13. Moreover, the spiral spring 5 is hooked at its outer circumference side end portion by the hook (although not shown) disposed at the starter case 1 and at its inner circumference end portion by the hook (although not shown) formed at the inner circumference edge of the rope reel 3.

The cylindrical cam 4 has a double wall of an outer side wall 17 and an inner side wall 18, between which an annular space portion 20 is formed. Cam pawls 19 are formed in the circumferential direction on the outer side wall 17. These cam pawls 19 are brought into and out of engagement with the centrifugal ratchet, although not shown, which is formed in a drive pulley to be connected with the output shaft of the engine. Moreover, a flange 21 is formed from the root portion and on the outer side of the outer side wall 17, and an annular engaging ridge 22 is formed on the inner side of the inner side wall 18 and at a position substantially corresponding to the flange 21. An extending cylindrical portion 23 is formed on the side of the rope reel 3 closer to the engaging ridge 22 of the inner side wall 18. In the end portion of the cylindrical cam 4 on the engine side, moreover, there is formed a through hole 24, which extends therethrough from the annular space portion 20.

The cylindrical cam 4 is so arranged on the reel spindle 2 as to overlap the rope reel 3, and its extending cylindrical portion 23 is rotatably inserted into the recess 14 formed on one side of the rope reel 3. Moreover, the inner side wall 18 of the cylindrical cam 4 is rotatably fitted on the reel spindle 2, and the engaging ridge 22 engages with the leading end of the spindle portion 2*a* and supports the engaging ridge 22 by the head portion 25 and the neck portion 26 of the set screw 7 so that it may not come out. The flange 21 of the cylindrical cam 4 is positioned in engagement with the inner side of the annular edge 15 of the rope reel 3.

The constitution thus far described forms an annular space portion 28 between the cylindrical cam 4 and the reel spindle 2 and merges into the annular space portion 20 and houses the coil spring 6. This coil spring 6 is housed such that it is wound on the outer side of the extending cylindrical portion 23. The coil spring 6 is provided at its one end with a U-shaped hook 30 and at its other end with an axial end portion 31, which is perpendicular to the winding direction. Moreover, the U-shaped hook 30 engages with the engaging groove 12 of the rope reel 3, and the axial end portion 31 is inserted into the through hole 24 of the cylindrical cam 4.

According to the constitution thus far described, when the starter rope 8 is pulled to turn the rope reel 3 on the reel spindle 2, the coil spring 6 is wound and fastened to store the energy. At first, the cylindrical cam 4 is prevented from turning by the starting resistance of the engine. As the force stored in the coil spring 6 overcomes the starting resistance, the spring force is released from the coil spring 6 to thereby rotate the cylindrical cam 4 and the drive pulley so that the output shaft of the engine, as connected to the drive pulley, is rotated and started.

When the starter rope 8 is pulled to rotate the rope reel 3, the spiral spring 5 is also wound and fastened. When the starter rope 8 is released after the engine is rotated, the rope reel 3 is rotated backward by the force stored in the spiral spring 5 to thereby wind back the starter rope 8, as pulled out, onto the rope reel 3.

A bottom seat face 34 of the rope reel 3 is divided into an inner annular portion 32 for receiving the leading end of the extending cylinder portion 23 of the cylindrical cam 4, and an outer annular portion 33 for receiving the longitudinal end portion of the coil spring 6, and these two annular portions 32 and 33 are not flush with each other.

The inner annular portion 32 for receiving the extending cylindrical portion 23 is formed to have the same height, but the outer annular portion 33 for receiving the coil spring 6 is not formed to have the same height. As specifically shown at (a) and (b) in FIG. 3, a portion a of the outer annular portion 33 that corresponds to the engaging groove 12 is formed as high as the inner annular portion 32, but a portion on the opposite side is formed higher than the inner annular portion 32. Moreover, the difference of the outer annular portion 33 between the lowest portion a and the highest portion b is formed to one half of the wire diameter of the coil spring 6.

The coil spring 6 is formed in the spiral shape so that the hook 30 or the end portion of the wire is the lowest at the end portion to engage with the bottom seat face 34 of the recess 14. The coil spring 6 rises by its diameter when it makes one turn from the hook 30 and returns to the portion of the original hook 30. Therefore, the portion b at one half turn from the hook 30 is higher by one half of the wire diameter than the portion of the hook 30.

Moreover, the outer annular portion 33 is formed to become gradually higher on the two sides of the portion a corresponding to the engaging groove 12, and to become the highest on the opposite side. As a result, the lowest portion a and the highest portion b are connected through arcuate slope faces c on the two sides. Moreover, the step p between the lowest portion a and the highest portion b of the outer annular portion 33 is set to one half of the wire diameter of the coil spring 6.

As described above, the outer annular portion 33 is the lowest at the portion a corresponding to the engaging groove 12 of the hook 30 but is higher by the step p (of one half of the wire diameter) on the opposite side. Therefore, the hook 30 is arranged on the outer annular portion 33 to engage with the engaging groove 12. The coil spring 6 abuts at its entire bottom portion against the outer annular portion 33, and the coil spring 6 is aligned at its center with the center of the extending cylindrical portion 23 of the cylindrical cam 4. Moreover, the coil spring 6 engages at its hook 30 with the engaging groove 12 so that it is arranged in a stable position on the outer annular portion 33. When the coil spring 6 is wound up by pulling the rope, therefore, it is stably wound and fastened.

At the portion b of the coil spring 6 on the opposite side of the hook 30, as shown in FIG. 1, the leading end 23*a* of the extending cylindrical portion 23 of the cylindrical cam 4 is arranged at the inner annular portion 32 lower by one half of the wire diameter than the coil spring 6, so that the coil spring 6 cannot enter the clearance between the extending cylindrical portion 23 and the inner annular portion 32. As a result, it is possible to prevent the problem that the coil spring 6 is deformed to increase the stress or to deteriorate the durability.

On the other hand, the portion a, corresponding to the engaging groove 12 of the outer annular portion 33 is formed to have the same height as that of the inner annular portion 32. As a result, the coil spring 6 may enter the clearance between the extending cylindrical portion 23 and the inner annular portion 32. However, the hook 30 of the coil spring 6 engages with the engaging groove 12. Even if the coil spring 6 is wound and fastened, therefore, the portion continuing from the hook 30 is held by the portion near the engaging groove 12 but does not approach the inner side. As a result, it is possible to effectively prevent the phenomenon that the coil spring 6 goes below the extending cylindrical portion 23.

Preventing the entry of the coil spring 6 is not only effected with the structure wherein the fitting groove for fitting the extending cylindrical portion 23 is not formed in the aforementioned recess 14, but also wherein the opposite side of the hook 30 is raised, while noting the spiral shape of the coil spring 6, to prevent that entry. The portion corresponding to the engaging groove 12 of the outer annular portion 33 is at the same height as that of the inner annular portion 32. It is, therefore, unnecessary to increase the overall height for prevent the entry of the coil spring 6.

Still moreover, the engaging groove 12 is formed generally into the T-letter shape, and the outer annular portion 33 is formed to connect the two sides of the highest portion b and the lowest portion a through the symmetric arcuate slope faces c. As a result, the constitution can match the coil spring 6 no matter whether the coil spring 6 might be wound clockwise or counter-clockwise.

The outer annular portion 33 may have the lowest portion a and the highest portion b but need not be continuously formed.

On the other hand, it is preferable that the step p between the lowest portion a and the highest portion b of the outer annular portion 33 is set to one half of the wire diameter, but the setting should not be necessarily limited thereto. The step p may be one third, two thirds or so of the wire diameter of the coil spring 6.

What is claimed is:

1. A recoil starter comprising:

a rope reel including a starter rope wound thereon with its one end being arranged outside of a starter case, and urged to rewind the starter rope;

a cylindrical cam for transmitting the rotation of the rope reel to an output shaft on an engine side, the cylindrical cam including an extending cylindrical portion extending from one side thereof;

a coil spring connecting the rope reel and the cylindrical cam;

a reel spindle for supporting the rope reel and a cam; and a hook formed at one end of the coil spring;

a recess formed in one side of the rope reel;

an engaging groove opened in the inner face of the recess;

an inner annular portion for receiving a leading end of the extending cylindrical portion; and an outer annular portion for receiving the coil spring, wherein:

the extending cylindrical portion rotates with the cylindrical cam and is provided on one side of the rope reel and inserted in the inner side of the recess;

the coil spring is wound on the outer side of the extending cylindrical portion;

the hook is engaged with the engaging groove;

an end portion opposite the hook is engaged with the cylindrical cam;

the inner annular portion is formed at the bottom face of the recess, and is made flush; and the outer annular portion is made such that a portion corresponding to the engaging groove is formed to have the same height as that of the inner annular portion whereas an opposite side is formed to have a larger height than that of the inner annular portion.

2. A recoil starter according to claim 1, wherein the hook is formed into a U-letter shape.

3. A recoil starter according to claim 2, wherein a step between the lowest portion and the highest portion of the outer annular portion is one half of the wire diameter of the coil spring.

4. A recoil starter according to claim 3, wherein the outer annular portion includes its highest and lowest portions connected on the two sides by symmetric arcuate slope faces.

* * * * *